United States Patent [19]

Pevzner

[11] Patent Number: 4,576,557

[45] Date of Patent: Mar. 18, 1986

[54] CRYOGENIC LIQUID PUMP

[75] Inventor: Boris Pevzner, Williamsville, N.Y.

[73] Assignee: Union Carbide Corporation, Danbury, Conn.

[21] Appl. No.: 504,435

[22] Filed: Jun. 15, 1983

[51] Int. Cl.[4] ..... F16J 10/02; F04B 15/06

[52] U.S. Cl. ..... 417/539; 477/454; 477/901; 92/170; 92/171; 29/156.4 WL

[58] Field of Search ..... 417/454, 539, 901; 92/170, 171, 144; 29/156.4 WL

[56] References Cited

U.S. PATENT DOCUMENTS

| | | | |
|---|---|---|---|
| 1,879,370 | 9/1932 | McAllister | 92/144 |
| 1,979,476 | 11/1934 | Labaw | 29/156.4 WL |
| 2,118,317 | 5/1938 | Madar | 29/156.4 WL |
| 2,292,375 | 8/1942 | Hansen . | |
| 2,439,958 | 4/1948 | Anderson | 92/144 |
| 2,440,216 | 4/1948 | Anderson | 92/144 |
| 2,630,072 | 3/1953 | Fausek et al. | 417/901 |
| 2,931,313 | 4/1960 | Hughes | 92/144 |
| 2,973,629 | 3/1961 | Lady . | |
| 3,109,293 | 11/1963 | Williams et al. | 417/901 |
| 3,145,629 | 8/1964 | Gottzmann | 92/144 |
| 3,206,110 | 9/1965 | Warbal | 92/144 |
| 3,372,648 | 3/1968 | Hammelmann | 92/171 |
| 3,623,235 | 1/1972 | Grewci | 417/901 |
| 3,792,939 | 2/1974 | Lalis | 92/171 |
| 3,811,801 | 5/1974 | Buse | 417/539 |
| 3,994,626 | 11/1976 | Stock et al. | 417/454 |
| 4,239,463 | 12/1980 | Yaindl | 417/539 |
| 4,393,752 | 7/1983 | Meier | 92/144 |
| 4,447,195 | 5/1984 | Shuck | 417/501 |

*Primary Examiner*—William L. Freeh

*Attorney, Agent, or Firm*—Alvin H. Fritschler

[57] ABSTRACT

A reciprocating-type pump with simplified construction and enhanced performance is achieved by the use of a unitary, rigid pump body support structure and modular pump component designs. This unitary structure includes forward and rearward pump body mounting plates to which the pump body is secured, with the overall support structure being securely attached to the power frame of the pump by means of a power frame mounting plate. Rigid connecting members secure said plates together to form the unitary structure that is particularly advantageous for use in the fabrication of cryogenic pumps suitable for high pressure operation. Valve means, packing means and a pump body cooling jacket can be conveniently secured to the unitary support structure.

27 Claims, 3 Drawing Figures

CRYOGENIC LIQUID PUMP

BACKGROUND OF THE INVENTION

1. Field of the Invention

The invention relates to cryogenic liquid pumps. More particularly, it relates to a reciprocating-type pump for cryogenic liquids.

2. Description of the Prior Art

The pumping of cryogenic liquids is confronted with problems in heat management and materials selection in light of the low temperatures involved in such operations. Heat conduction from the warm end of a cryogenic pump to the pumping chamber portion of the pump body, heat in-leakage from the ambient environment, frictional heat generated by the reciprocating motion of the plunger, and heat generation in the pumping chamber due to fluid compression have long been recognized as major sources of pump inefficiency.

The principal prior art approach for overcoming such problems has been to endeavor to intercept the heat conducted from the warm end of the pump by means of heat exchange with a cold fluid. Thus, pumps utilizing suction liquid, blowby fluid and pressurized liquid as a cold heat fluid have been proposed in the art. For example, Picard, U.S. Pat. No. 1,895,295, described the submersion of the pump in a cryogenic liquid and the use of heat transfer fins on the pump body to improve heat transfer between the pumping chamber and the pump liquid. Similarly, Hughes, U.S. Pat. No. 2,931,313, and Lady, U.S. Pat. No. 2,973,629, provide an annular cooling jacket surrounding the pumping chamber, with cryogenic liquid being passed through said cooling jacket prior to being introduced into the pumping chamber on a suction stroke of the pump. In the Riede, U.S. Pat. No. 2,730,957, Gottzmann, U.S. Pat. No. 3,136,136 and Schuck, U.S. Pat. No. 4,156,584, patents, blowby fluid is passed in a direction opposite to the heat flux so as to intercept the heat conducted from the warm end of the pump. While such approaches can effectively prevent major problems, such as vapor binding, which would normally accompany an inordinate heat flux to the cold end of a pump, there are disadvantages associated therewith. Most importantly, it is not feasible to precisely control the amount of cooling being accomplished. In many instances, therefore, the warm end of the pump may actually become too cold for proper packing performance. Frost may actually form in some cases and destroy the packing. As a result, auxiliary heating means may have to be employed in many instances to enable continued trouble-free operation under a range of operating conditions. Such a heating requirement represents an additional and otherwise unnecessary heat load in the pump.

In addition to such efforts to prevent the conduction of heat from the warm to the cold end of cryogenic pumps, the prior art has also endeavored to control such heat conduction by appropriate structural means. In both the Riede and the Schuck patents referred to above, for example, a thin tubular section is employed to connect the cold pumping chamber to the warm packing end of the pump. The heat flux from the warm end of the pump was said to be minimized by making such tubular section as long and as thin as is consistent with adequate structural strength. In the designs shown in both patents, the thickness of the pump body is increased in the pumping chamber portion of the pump as is necessary to withstand the pressure loading, i.e. the hoop stress, on this portion of the pump. While such an approach provides some improvement in the art of cryogenic pump design, it will be appreciated that the degree to which the thickness of the thin tubular section can be reduced is constrained by the tensile loads developed during operation of the pump. The Riede and Schuck patents, for example, teach that the tubular section must, in combination with the thicker pumping chamber portion of the pump body, bear the tensile and hoop stresses created by the pumping pressure. Accordingly, the thickness of the tubular section must be sufficient to support this tensile load although a thinner construction would otherwise be desirable for purposes of minimizing the heat flux from the warm end to the cold end of the pump.

A particularly desirable approach to such heat management problems is disclosed in U.S. patent application Ser. No. 202,476, entitled "Cryogenic Reciprocating Pump," filed Oct. 31, 1980. As disclosed therein, the pump body has a flange at its forward end that is integral with the cylindrical shell. The shell is spaced apart from the pump body so as to form an annular insulation space surrounding the pump body. The shell, at its opposite end, is attached to another flange positioned at the base of the pump's packing assembly. The pump body is rigidly secured to a suitable power frame by still another flange that is affixed to the cylindrical shell. The rearward end of the pump body is coupled to the packing assembly by a thin corrugated metal member that is capable of minor axial adjustment under the influence of external deforming forces, e.g. such forces caused by thermal expansion and contraction of the pump body. The packing assembly is actually supported by the cylindrical shell through its mounting on the flange affixed to said shell. The latter approach serves to remove the tensile stresses that could otherwise exist in the pump body as a result of axial temperature differences and the end load produced by the pump pressure. As a result, it is possible to achieve desirable reductions in the size and weight of the pump body. In addition, this approach also serves to significantly reduce the axial heat conduction from the warm end to the cold end of the pump since the thin corrugated metal member that constitutes the only direct thermal link between the two ends represents a significant impediment to heat transfer from the warm end to the cold end of the pump.

In terms of thermally isolating the pump body portion from the drive frame, the general practice in the cryogenic pump art, including the design of said Serial Number referred to above, has been to engineer the pump body as an element distinct from the power frame. the pump body has been coupled to a mounting plate on the power frame by means of a suitable mounting flange. The pump assembly also normally employs a spacer element interposed between said mounting flange and the mounting plate for purposes of achieving the desired goal of thermally isolating the body portion of the pump from the drive frame. In any such pump design, therefore, each pump body section must be separately attached to the power frame and separately aligned with the centerline of the crosshead thereof. It will be appreciated that the proper positioning of the various components and the ultimate alignment of the overall pump assembly will be complicated as a result of the normal machining tolerances pertaining in the production of the various component parts. Moreover, the independent nature of the two major pump components tends to compound the problem of assembly alignment. In a triplex pump, for example, three pumping sections must be individually mounted on the power frame. Consequently, there are three opportunities for introducing an assembly-related misalignment into the pump assembly. In the basic prior art designs for cryogenic pumps, therefore, some element of misalignment must be tolerated. This misalignment serves to reduce the reliability and operating life of various pump components, such as the rider rings, piston rings, packing seal rings, and crosshead bearings. Furthermore, individual support of the multiple pumps will not provide the same rigidity as a unitary support under comparable weight and space limitations.

Because of the circumstances discussed above, it will be appreciated that there is a continuing desire to achieve further developments in the field of cryogenic pumps. In particular, there is a need and desire for the development of reciprocating-type cryogenic pumps capable of pumping cryogenic liquids at high operating pressures, i.e. at pressures in excess of about 500 psi. Such pumps are desired for operation with minimum heat leaks and cooldown losses, and with simplified pump construction and serviceability, together with improved pump reliability.

It is an object of the invention, therefore, to provide an improved cryogenic liquid pump.

It is another object of the invention to provide a reciprocating-type cryogenic pump suitable for high pressure operation.

It is another object of the invention to provide a cryogenic liquid pump having improved performance reliability and operating life.

It is a further object of the invention to provide an improved cryogenic pump capable of minimizing heat leaks and cooldown losses.

With these and other objects in mind, the invention is hereinafter described in detail, the novel features thereof being particularly pointed out in the appended claims.

SUMMARY OF THE INVENTION

This invention utilizes a unitary pump body support structure having forward and rearward pump body mounting plates and a power frame mounting plate that is precisely aligned with, and secured to, the power frame of the pump. The valve assembly, pump body, packing assembly and pump body cooling jacket can advantageously be mounted on said unitary support structure.

BRIEF DESCRIPTION OF THE DRAWINGS

The invention is further described with reference to the accompanying drawings in which.

DETAILED DESCRIPTION OF THE INVENTION

Figure 1:
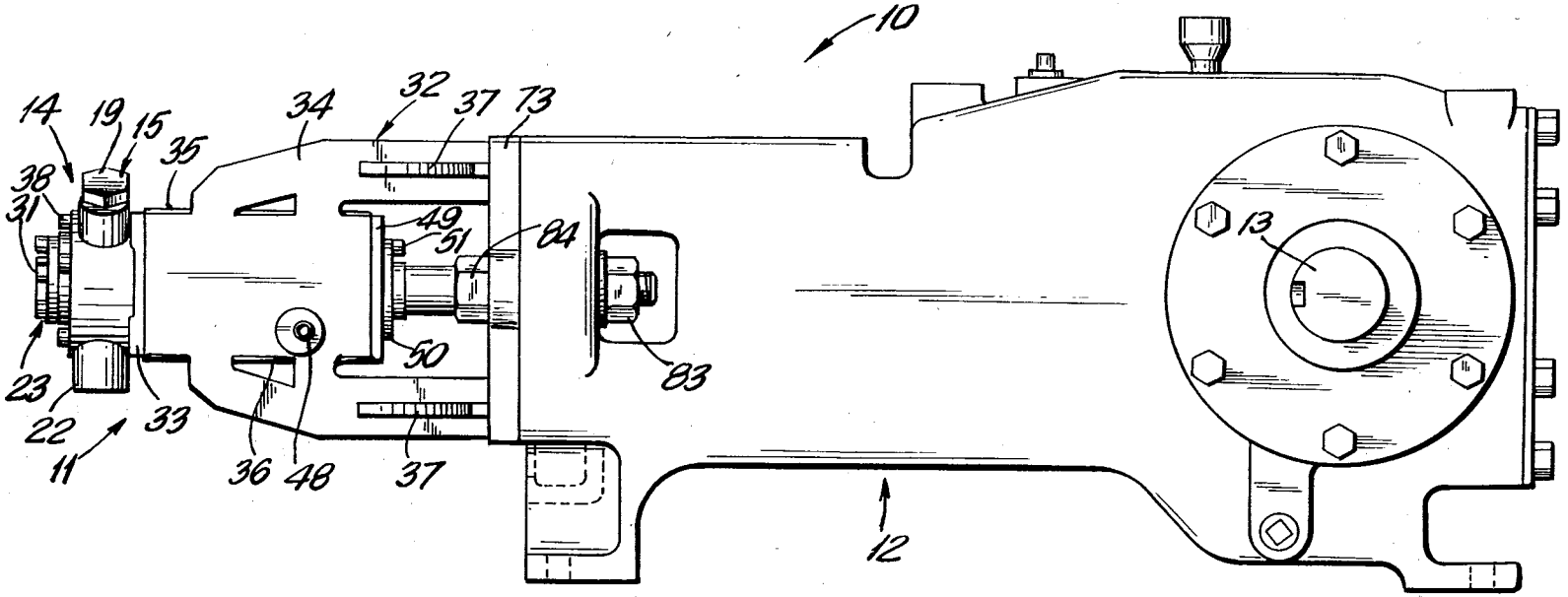
FIG. 1 is a side elevation view of an embodiment of the improved cryogenic liquid pump of the invention.

The objections of the invention are accomplished by the use of the unitary pump body support structure referred to above that, in effect, becomes an extension of the power frame. This unitary support structure serves as a foundation or superstructure for mounting various functional components of the pump. Consequently, such components do not have to be structurally self-supporting and can be designed so as to merely satisfy their specific functional purpose without additional requirements for support purposes. This feature thus tends to reduce both the size and the weight of the various functional components. In addition, the pump design based on the use of the unitary pump body support structure as herein disclosed and claimed enables the pump components to be separately fabricated and assembled, not only reducing the cost of fabrication but also enabling the pump to be more easily serviced and its parts to be more easily replaced.

The unitary pump body support structure, described in detail below, is conveniently assembled by welding its various elements together. Such elements include a forward pump body mounting plate, a rearward pump body mounting plate and a power frame mounting plate that is precisely aligned with, and secured to, the power frame of the pump. Before being welded together, the three plates may be rough machined to provide the necessary bores therethrough for the pump body and plunger, although such machining may be accomplished after the assembly is welded together. In a triplex assembly in which three pump cylinders are employed, three such holes must be provided in each of the plates. Final machining of the bores is accomplished after the assembly has been welded together. By constructing the unitary assembly in this manner, it is possible to maintain extremely close tolerances in the location of the centerlines of each cylinder bore, with a tolerance of 1 mil being readily obtainable for example. In other words, the positioning of the centerline of each bore with respect to the other bores of multi-cylinder pump designs and to the alignment pin holes for securing the plates can be made within 1 mil, i.e. 1/1000", of being exact. Consequently, when the alignment pins locate the unitary support structure on the power frame, there is a very close alignment between the centerlines of the crosshead bores and the centerlines of each pump body. This improved alignment reduces the loads on various pump components and improves the service life and reliability of those pump components, including the piston rings, rider rings, packing sealing rings and crosshead bearings.

In accordance with the invention, therefore, the pump body is mounted on a rigid pump body support structure, i.e. a unitary superstructure, which is precisely aligned and structurally integral with the power frame or drive means of the pump. The pump body support structure includes elongate, rigid connecting members to which a forward pump body mounting plate, a rearward pump body mounting plate and a power frame mounting plate are rigidly secured in a spaced apart relationship. The pump body itself is positioned and supported by the forward and rearward pump body mounting plates. This arrangement permits improved pump body alignment with the reciprocating plunger and eliminates the longitudinal stresses in the pump body, as such stresses are borne instead by the unitary pump body support structure. Consequently, the pump body can be made smaller in size, thereby reducing fabrication costs and cooldown losses. Reduction of both fabrication costs and cooldown losses are important advantages with respect to pumps being used to pump cryogenic liquids, as in oil field servicing applications.

Figure 2:
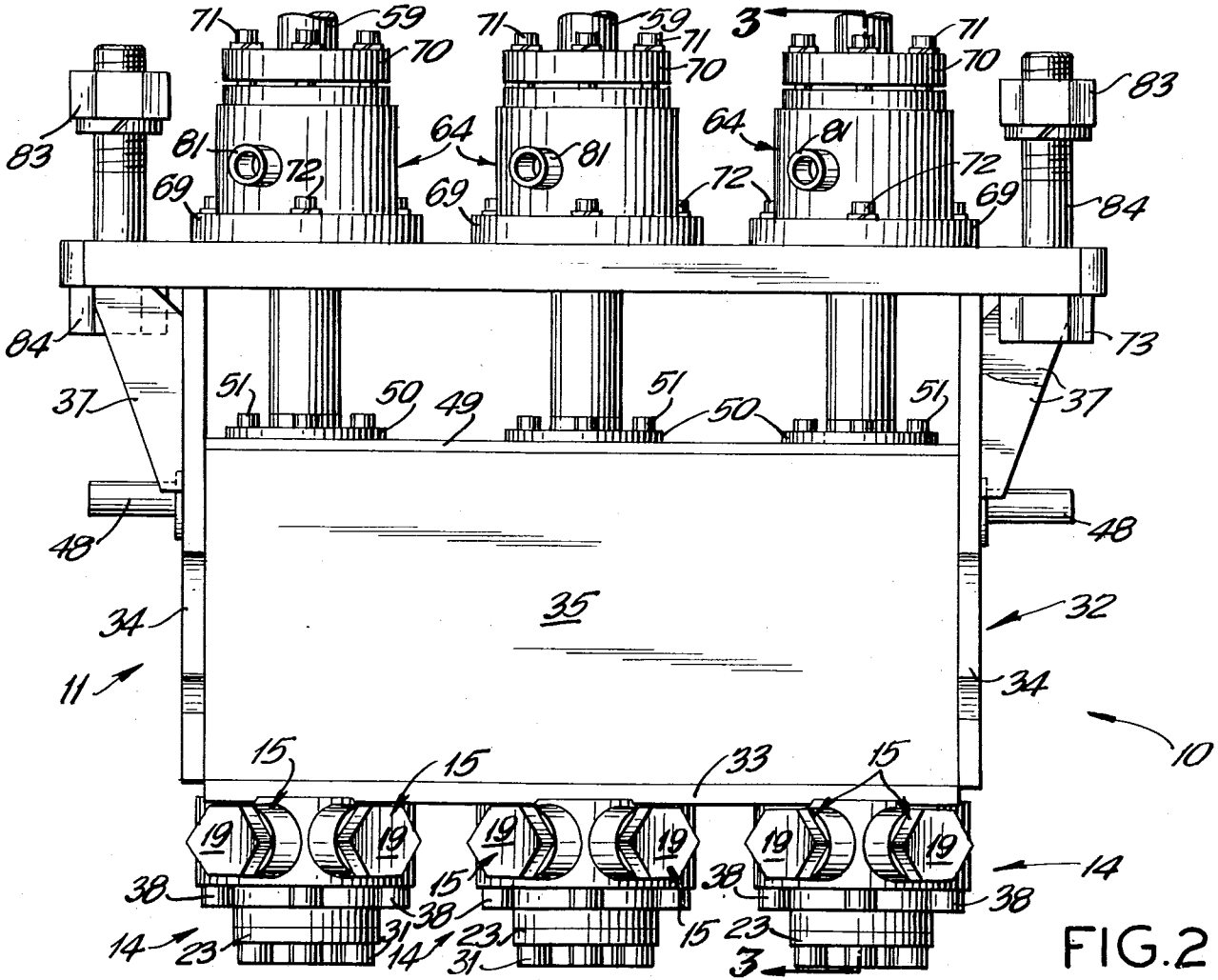
FIG. 2 is an overhead plan view of the pump illustrated in FIG. 1.

Referring to the drawings and in particular to FIGS. 1 and 2 thereof, a horizontal, reciprocating-type cryogenic liquid pump 10 constructed in accordance with the invention is illustrated as a triplex pump, i.e. one having three pump chambers and plungers, as is frequently employed for oil field service applications. Generally in such applications, the pump is mounted on a trailer skid, together with the required motive power source. An on-board source of cyrogenic liquid, e.g. liquid nitrogen, is also provided. In this manner, the total pumping assembly can readily be used at a number of different remote service locations, although it will be understood that stationary pumping complexes are also within the scope of the invention.

Pump 10 includes pumping section 11 and drive means, or power frame 12, which in the illustrated embodiment is of well-known triplex design. As is well known in the art, crank shaft 13 of said power frame 12 is coupled to any suitable prime mover (not shown), such as an electric motor or a diesel or gasoline engine.

Pumping section 11 includes valve assembly 14, unitary pump body support structure 32, packing means or assembly 64 supported thereon, and plunger 59 connected to crank shaft 13 on power frame 12 through a conventional crosshead-connecting rod arrangement. Valve assembly 14 is shown as a preferred unitary assembly, with each such valve assembly including two discharge valves 15, discharge port 22 and suction valve assembly 23.

In the illustrated embodiment, unitary pump body support structure 32 includes a forward pump body mounting plate 33, rearward pump body mounting plate 49 and power frame mounting plate 73, with said components being spaced apart from one another and secured together in a unitary assembly by means of elongate, rigid connecting members comprising side plates 34, and top and bottom plates 35 and 36, respectively. In some embodiments, the top and bottom plates may be omitted, or a combination of some of such elongate, rigid connecting members employed so long as the desired rigidity is imposed upon the unitary structure thereby. Gussets 37 reinforce the attachment of side plates 34 to power frame mounting plate 73 in the illustrated embodiment. Unitary rigid pump body support structure 32 is precisely aligned with and securely connected to power frame 12 by means of suitable alignment pins, not shown, and nuts 83 and bolts 84. By such means, said support structure 32 actually becomes an extension of power frame 12, and serves as an advantageous foundation or superstructure for the mounting of various functional components as was noted above.

Figure 3:
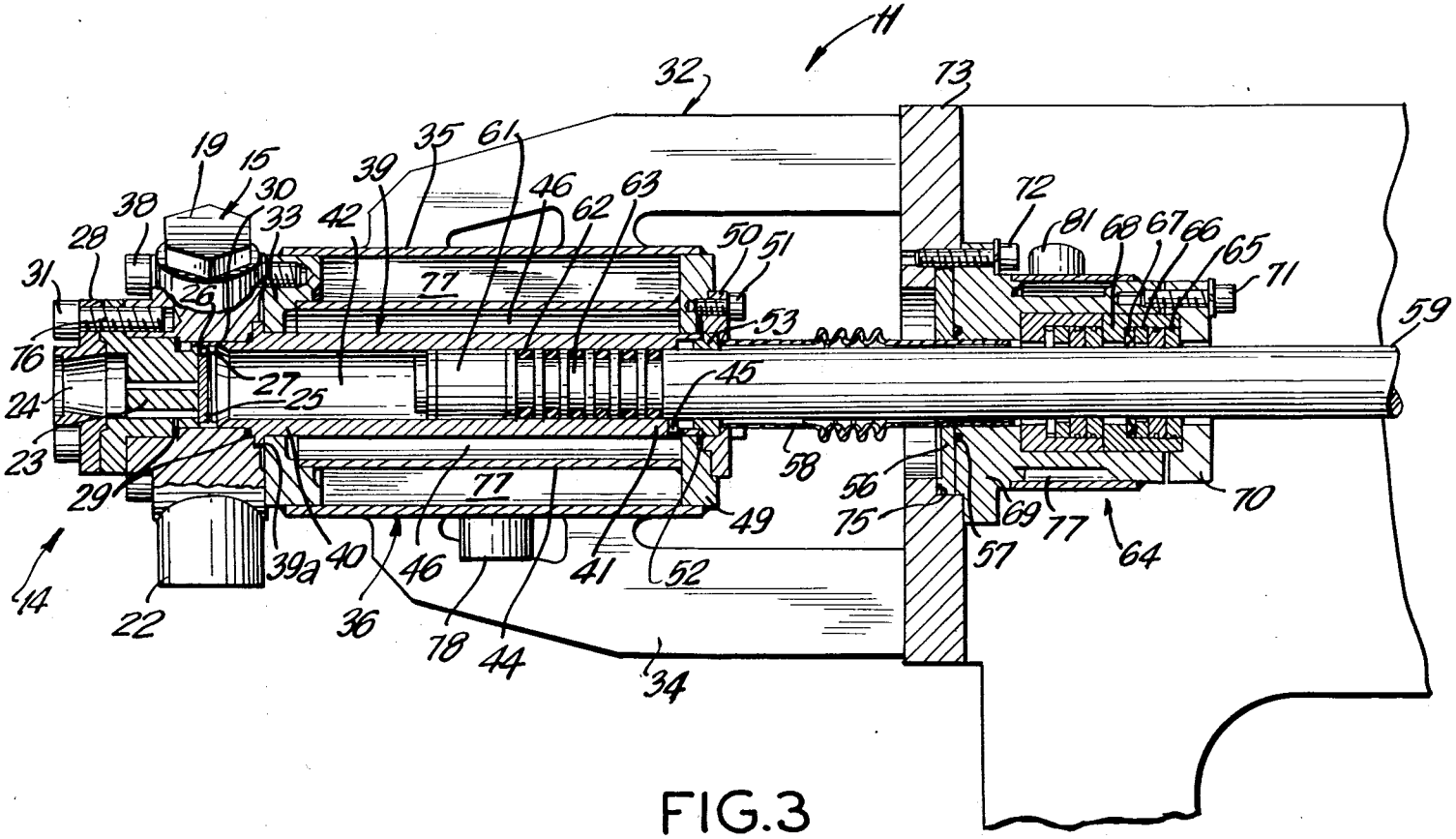
FIG. 3 is a cross-sectional view of the pump of FIG. 2 taken along line 3—3 thereof.

The pumping section 11 of cryogenic pump 10 herein disclosed and claimed is shown in further detail in FIG. 3, wherein said pumping section 11 is shown as including pump body 39 having forward end 40 and rearward end 41. Pump body 39 also has a cylindrical bore therethrough forming cylindrical pumping chamber 42 therein. It will be seen that pump body 39 is located on unitary pump body support structure 32 by means of closely machined bores in said forward and rearward mounting plates 33 and 49. Thus, forward end 40 of pump body 39 is secured to forward mounting plate 33 by valve assembly 14 and bolts 38. Valve assembly 14, which is firmly mounted on said mounting plate 33 by means of bolts 38, engages shoulder 39 at the forward end of pump body 39 so as to thereby lock pump body 39 in place on said forward mounting plate 33. By thus supporting pump body 39 on said unitary, rigid pump body support structure 32, a sizeable size and weight reduction can be realized for said pump body 39. Such sizeable reduction in the mass of the pump body enables a significant reduction in cooldown losses to be achieved since the mass of the pump has to be cooled down to cryogenic liquid temperatures during pump startup. In other words, a significant reduction can be achieved in the quantity of liquid that must be used to cool the pump to operating conditions, with such reduction directly translating to a desirable operating cost serving in addition to the apparatus cost savings from the reduction in size and weight made possible by the need only to design the pump body to satisfy its specific functional purpose without the need for such pump body to be structurally self-supporting.

Plunger 59, connected at one end to drive means 12 through a conventional crosshead (not shown), extends into pumping chamber 42 through rearward end 41 of said pump body 39 for reciprocating motion therein. Said plunger 59 fits within the bore of the pumping chamber fairly closely so as to provide a sliding fit. Proper guidance of the plunger within pumping chamber 42 is provided by rider ring 61 and said crosshead. The rider ring may conveniently be made of carbon-filled Teflon. Primary sealing between plunger 59 and pump body 39 is achieved by employing a number of piston rings 62. Such rings are also conveniently made of carbon-filled Teflon and may be energized by beryllium-copper ring-type springs 63. Piston rings 62 provide a seal with both the shoulder of said plunger 59 and the inner wall of pump body 39.

A secondary seal against blowby fluid loss from pumping section 11 is provided by packing means or assembly 64. This packing assembly consists of two sets of sealing rings 65, packing thrust washers 66 and wave washers 67. The sealing rings are advantageously made from carbon-filled Teflon. Each of said sealing ring, packing thrust washer and wave washer sets is inserted into a packing cup 68. Said packing cup 68 is then piloted into packing gland 69, and packing retainer 70 is positioned over packing assembly 64 and secured in place by screws 71. The packing assembly is in turn mounted on power frame mounting plate 73 of said unitary support structure 32 by means of screws 72 so as to surround plunger 59 and seal pumping section 11 against the leakage of fluid therefrom. By supporting packing assembly 64 on power frame mounting plate 73 of unitary pump body support structure 32 rather than directly on pump body 39, a size and weight saving inures to said pump body 39 as a result of the lower stress thereby imposed thereon. In addition, less heat is transferred from the packing assembly through pump body 39 to pumping chamber 42 therein. Consequently, the operating conditions pertaining to the packing assembly are improved, and the need to warm said packing assembly, a common requirement of most prior art pumps, is significantly relaxed. If necessary or desired, however, packing assembly 64 can be warmed by the use of warming jacket 79, which is provided with an inlet conduit (not shown) and outlet conduit 81.

FIG. 3 illustrates one embodiment of desirable means for leak-tightly coupling the rearward end 41 of pump body 39 to said packing assembly 64. As shown, said rearward end 41 engages rearward pump body mounting plate 49 of unitary pump body support structure 32. As disclosed above, said mounting plate 49 is held in position by welds with side plates 34, top plate 35 and bottom plate 36 of said unitary support structure 32.

Blowby seal cap 50 is secured to mounting plate 49 by screws 51. Leakage between said seal cap and the mounting plate is impeded by gasket 52 that is compressed therebetween. Packing gland seal cap 56 is wedged against shoulder 75 on power frame mounting plate 73 by said packing assembly 64. A Teflon or other suitable O-ring 57 is positioned between seal cap 56 and packing gland 69 of packing assembly 64 for sealing therebetween. Bellows assembly 58 is welded at one end to said blowby seal cap 50 and, at its other end, to said packing gland seal cap 56. The arrangement restricts heat in-leakage to pump body 39 from packing assembly 64 and also allows for some imprecision in the axial positioning of said pump body 39 with respect to power frame mounting plate 73. Moreover, it permits minor axial adjustment of the spacing between rearward end 41 of pump body 39 and said packing assembly 64 precipitated, for example, by thermal expansion and contraction resulting from the temperature differential established between forward end 40 of pump body 39 and said packing means 64.

During operation of the pump, liquid enters pumping chamber 42 through inlet part 24 under the control of suction valve assembly 23 during each suction stroke of plunger 59. The suction valve assembly can be of the conventional disk or plate-valve type that includes valve plate 25 that is laterally guided by means of valve cage 26 and balls 27. Valve plate 25 rests on suction valve seat 28. Fluid flow openings 29 are provided in the suction valve seat for permitting liquid to flow therethrough during the suction stroke. The movement or lift of valve plate 25 during a suction stroke is restricted by flange 30 on valve cage 26. The complete suction valve assembly 23 is secured to valve assembly 14 by screws 31 inserted through bores 76.

Liquid is discharged during each discharge stroke of the pump through discharge port 22 under the control of discharge valve 15. Each such valve includes a discharge valve port fitted with a discharge valve seat, a stainless steel valve ball and a discharge valve retainer 19, which permits the installation of the discharge valve seat and restricts the movement of the valve ball. As this aspect of the overall pump of the invention is of conventional design and does not pertain to the heart of the invention as described and claimed herein, details of the discharge valve have not been illustrated by a separate figure of the drawings.

An important and highly desirable advantage of the design of the valve assembly as described above is that any one or all of valve assemblies 14, including the associated suction valve assembly 23 and discharge valves 15, can be easily removed from the pump for convenient servicing or replacement. Valve assembly 14 is a unitary element that can be simply bolted to forward pump body mounting plate 33 of the unitary support structure 32 by means of said bolts 38 used to mount pump body 39 to said mounting plate 33. Because of such ease of changeout, this arrangement also facilitates the testing of alternate suction and discharge valve designs. This desirable valve assembly arrangement also allows pump body 39 and said valve assembly 14 to be separately manufactured, thereby allowing each component to be lighter and less expensive as they can be designed simply to satisfy their specific functional purposes.

Returning again to FIG. 3, pump body 39 is shown as being surrounded by cooling jacket 44, which typically comprises a cylindrical metal tube. This cooling jacket is secured to mounting plates 33 and 49 and has a diameter larger than that of pump body 39 so that an annular cooling space 46 is formed about the pump body. In this embodiment, said cooling jacket 44 contributes to the rigidity of the unitary support structure of the invention. The rearward end 41 of pump body 39 is provided with a small aperture 45 that establishes flow communication between pumping chamber 42 and said annular space 46. The end of cooling jacket 44 opposite to that secured to forward pump body mounting plate 33 is sealed by rearward pump body mounting plate 49. Alignment bushing 53 is positioned against rearward end 41 of pump body 39 and is held in place by blowby seal cap 50. As noted above, the seal cap is firmly attached to the blowby mounting plate 49 by means of screws 51. The annular cooling spacers 46 surrounding each of the pump bodies 39 of pump 10 are interconnected by means of suitable blowby conduits (not shown). In addition, blowby vent conduits are conveniently provided on each of the outer pumps of illustrated triplex pump 10. During the discharge stroke of the pump, a small amount of fluid leaks around plunger 59. This fluid, commonly referred to as blowby fluid, helps to lubricate the plunger and serves as a means for removing heat from pumping chamber 42. In the embodiment illustrated in FIG. 3, the blowby fluid flows around plunger 59 towards the rearward end 41 of pump body 39. This fluid then flows through aperture 45 into said annular cooling space 46 surrounding each of the pump bodies for further cooling of said pump bodies. The blowby conduits referred to above for interconnecting pump bodies 39 can be used advantageously to help distribute the blowby fluid substantially uniformly through the annular cooling spaces 46 surrounding the various pump bodies 39. This optional feature insures that the various pump bodies are equally cooled and prevents any abnormal loads that might be caused by the uneven expansion and contraction of the cooling jackets accompnaying an unequal cooling of the pump bodies. The blowby fluid can conveniently be exhausted from the pump through convenient blowby vent conduits.

The entire pumping suction 11 of pump 10 is surrounded by an insulation space, i.e. by insulation space 77 as shown in FIG. 3. Insulation space 77 is bounded at the forward and rearward ends of the various pump bodies 39 by forward pump body mounting plate 33 and by rearward pump body mounting plate 49, respectively. Top plate 35 and bottom plate 36 of said unitary pump body support structure 32 form the upper and lower walls, respectively, of insulation space 77, and said side plates 34 of support structure 32 serve to complete the enclosure. The insulation space is commonly filled, in preferred embodiments of the invention, with a low conductivity material, such as perlite, to minimize in-leakage of heat from the ambient environment in which the pump is located and is being used. Port 78 can be advantageously employed to enable convenient filling of said space 77 with such low conductivity or other suitable material.

The invention is adapted for convenient use of an advantageous procedure for pump start-up. In oil field servicing applications, the cryogenic liquid to be pumped, generally liquid nitrogen, is typically brought to the application location via cryogenic transports or trailers, although, as noted above, the liquid supply is oftentimes included on the trailer containing the pump itself. In any event, the liquid supply is generally limited so that there is a substantial premium placed on effective liquid conservation measures. The design of the pump of the invention enavles a significant reduction to be achieved in the loss of valuable liquid during the cooldown procedure when the following cooldown technique is followed. Suction inlet ports 24 of the various pump chambers are first connected to the source of cryogenic liquid for priming pump 10. The discharge ports 22 are then connected to one of the blowby vent conduits 48, while the other blowby vent conduit 48 is connected back to the cryogenic liquid supply tank. When priming the pump, therefore,, the priming fluid is used not only to rapidly cool down the pump bodies by the forcing of said fluid through the annular cooling spaces 46 and said blowby conduits, but is also used to build up the pressure in the cryogenic tank that may be needed to satisfy the applicable suction requirements of the pump. Such functions are thus conveniently carried out with a minimal loss of cryogenic fluid.

Those skilled in the art will appreciate that various changes and modifications may be made in the details of the pump design herein described without departing from the scope of the invention based upon the advantageous unitary pump body support structure as recited in the claims. Whereas pump 10 as illustrated in the drawings is of triplex design, i.e. having three pumping chambers, as is often used for oil field service applications, it will be understood that various other arrangements, including a simplex design, are possible. It will also be appreciated by those skilled in the art that such pumps are commonly employed with 3 to 5 pumping chambers in preferred embodiments. The drive means or power frame 12 employed in the practice of the invention comprises known, commercially available units, such as the well-known triplex design contemplated for use with respect to the pump illustrated in the drawings. Power frames suitable for use in the practice of the invention can be obtained from established commercial sources, e.g. Union Pump Company and Ingersoll-Rand, Inc.

The unitary, rigid pump body support structure 32, as will be clearly understood from the description above, can advantageously be employed not only to conveniently support pump body 39, but also, in preferred embodiments of the invention, to likewise support valve assembly 14 and packing assembly 64. Thus, the unitary support structure can serve as a foundation for the mounting of a variety of functional components so as to reduce the size and weight thereof and to enable more ready servicing and replacement of parts than is possible with conventional pump designs. The unitary nature of the support structure will be seen as enabling very close alignment of parts so as to reduce stress on the pump body and to ensure enhanced pump performance and reliability. The pump body can be made small and lightweight, thereby rendering the body inexpensive to operate and capable of being used with low cooldown losses. If the unitary support structure were to allow very close alignment initially but were not of rigid construction, it will be appreciated that satisfactory operational performance under actual operating conditions would not be achieved. However, the unitary support structure as disclosed and claimed herein is of a rigid nature with rigid connecting members, such as side plates 34 or such plates together with bottom plate 36 and top plate 35, when employed, providing rigidity to the overall structure and enabling the advantageous benefits of the invention to be achieved. As unitary, rigid body support structure 32 includes power frame mounting plate 73, it will be appreciated that the unitary support structure and the functional components mounted thereon are precisely aligned with and firmly secured to power frame 12 so as to actually become, as noted above, an extension of said power frame 12. In this regard, it will be appreciated that power frame mounting plate 73 is considerably larger in overall size than rearward pump body mounting plate 49, thus providing a highly desirable means for mounting the pump body support structure and its attached functional components to the power frame portion of the pump. It will be appreciated that the forward and rearward mounting plates and the power frame mounting plate are desirably positioned parallel, or substantially parallel, with respect to one another for overall convenience of fabrication and use of the unitary support structure.

The pump of the invention is highly advantageous for use as a cryogenic liquid pump, particularly for high pressure operation in oil field service. As noted above, the valve head is conveniently bolted to the forward end of the unitary support structure and is easily removable, enabling relatively inexpensive construction and easy servicing in the field. The pump body is conveniently insulated to reduce heat in-leakage and, in preferred embodiments, the pump body is cooled by blowby fluid. Priming fluid can desirably be used both to cool the pump body and to build up liquid tank pressure. In addition, the unitary support structure of the invention enables the cold and the hot portions of the pump to be physically separated, i.e. by the space between rearward pump body mounting plate 49 and power frame mounting plate 73. Thus, packing assembly 64 and pump body 39 are separated rather than being merely insulated from each other.

For all of these reasons, the pump of the invention will be appreciated as constituting a major advance in the field of reciprocating cryogenic liquid pumps. The unitary rigid support structure thus enables construction and operating advantages to be achieved, reducing the cost and enhancing the performance of cryogenic liquid pumps for use in significant commercial applications such as the oil field servicing applications for which the invention is particularly useful.

I claim:

1. In a reciprocating-type pump adapted for the pumping of cryogenic liquids and including at least one: (1) pump body having a forward end, a rearward end and a cylindrical bore forming a pumping chamber therein; (2) power frame having a crank shaft comprising the driving means for said pump; (3) reciprocating plunger means connected to the crank shaft of said power frame and extending into the pumping chamber of said pump body through the rearward end thereof and adapted for reciprocating motion therein; (4) valve means in fluid communication with the pumping chamber and adapted for controllably introducing cryogenic liquid into the pumping chamber during each suction stroke of said plunger and for controllably discharging cryogenic liquid from the pumping chamber during each discharge stroke thereof; and (5) sealing means surrounding said plunger means for sealing the pump against fluid leakage, the improvement comprising a unitary, rigid pump body support structure connected to said power frame, said unitary support structure having a forward end pump body mounting plate, a rearward pump body mounting plate spaced apart from said forward plate, and a power frame mounting plate, said plates being secured together in permanent, non-mechanical joining by means of rigid connecting members, said plates having bores therein for each pump body secured thereto and for said sealing means, whereby said unitary support structure can be precisely aligned with and securely connected to said power frame, each pump body mounted on said forward and rearward mounting plates advantageously being of relatively light weight and size providing overall cost savings and enhanced performance capability for said pump.

2. The cryogenic pump of claim 1 in which said valve means is mounted on the forward end pump body mounting plate of said unitary, rigid pump body support structure, said valve means thus being easily removable from the pump for servicing and/or replacement.

3. The cryogenic pump of claim 2 in which said valve means comprises a unitary valve assembly including a suction valve assembly and discharge valves.

4. The cryogenic pump of claim 1 and including packing means supported on the power frame mounting plate of said unitary, rigid pump body support structure.

5. The cryogenic pump of claim 4 in which said packing means supported on said power frame mounting plate is separated from the rearward end of the pump body by a distance at least equal to the stroke length of the reciprocating plunger.

6. The cryogenic pump of claim 5 and including a warming jacket for warming said packing assembly.

7. The cryogenic pump of claim 5 and including means for leak-tightly coupling the rearward end of the pump body to said packing means.

8. The cryogenic pump of claim 1 in which said unitary rigid pump body support structure connecting members comprise rigid side plates attached to said forward and rearward pump body mounting plates and to said power frame mounting plate.

9. The cryogenic pump of claim 1 and including a cooling jacket surrounding said pump body and secured to said forward and rearward mounting plates of the unitary support structure, the diameter of said cooling jacket being larger than said pump body, an annular cooling space thus being formed about said pump body.

10. The cryogenic pump of claim 9 in which said pump body has means for establishing fluid communication between the pumping chamber therein and said annular cooling space and including means for exhausting fluid from said annular cooling space.

11. The cryogenic pump of claim 10 and including conduit means for distributing blowby fluid substantially uniformly through the annular cooling spaces surrounding each pump body.

12. In a reciprocating-type pump adapted for the pumping of cryogenic liquids and including at least one: (1) pump body having a forward end, a rearward end and a cylindrical bore forming a pumping chamber therein; (2) power frame having a crank shaft comprising the driving means for said pump; (3) reciprocating plunger means connected to the crank shaft of said power frame and extending into the pumping chamber of said pump body through the rearward end thereof and adapted for reciprocating motion therein; (4) valve means in fluid communication with the pumping chamber and adapted for controllably introducing cryogenic liquid into the pumping chamber during each suction stroke of said plunger and for controllably discharging cryogenic liquid from the pumping chamber during each discharge stroke thereof; and (5) sealing means surrounding said plunger means for sealing the pump against fluid leakage, the improvement comprising a unitary rigid pump body support structure connected to said power frame, said unitary support structure having a forward end pump body mounting plate, a rearward pump body mounting plate spaced apart from said forward plate and a power frame mounting plate, said plates being secured together by means of rigid connecting members, said plates having three pump bodies mounted thereon, said pump comprising a triplex pump and having very closely aligned bores therein for each of said three pump bodies secured thereto and for said sealing means, whereby said unitary support structure can be precisely aligned with and securely connected to said power frame, each of said three pump bodies mounted on said forward and rearward mounting plates advantageously being of relatively light weight and size providing overall cost savings and enhanced performance capability for said pump.

13. The cryogenic pump of claim 12 in which said valve means is mounted on the forward end pump body mounting plate, and including packing means supported on the power frame mounting plate of said unitary, rigid pump body support structure.

14. The cryogenic pump of claim 13 and including a cooling jacket surrounding said pump body and secured to said forward and rearward mounting plates of the unitary support structure.

15. The cryogenic pump of claim 13 in which said pump is adapted for operation at high outlet fluid pressures.

16. The cryogenic pump of claim 15 in which said high operating pressure is greater than 500 psi.

17. A unitary, rigid pump body support structure adapted for connection to the power frame of a pump comprising for each pump body:

(a) a forward end pump body mounting plate;
(b) a rearward pump body mounting plate spaced apart from said forward plate for the securing of a pump body therebetween;
(c) a power frame mounting plate; and
(d) rigid connecting members connecting in permanent, non-mechanical joining the forward and rearward mounting plates and said power frame mounting plate to form said unitary structure, said plates having very closely aligned bores therein for each pump body to be secured thereto and for sealing means surrounding each reciprocating plunger of said pump, whereby said unitary structure can be precisely aligned with and securely connected to said power frame.

18. The unitary support structure of claim 17 in which said connecting members comprise side plates attached to said mounting plates.

19. The unitary support structure of claim 18 and including bottom and top plates as rigid connecting members for said mounting plates.

20. The unitary support structure of claim 17 and including means for mounting the valve means for the pump to the forward end pump body mounting plate of said unitary support structure.

21. The unitary support structure of claim 20 and including means for supporting packing means on the power frame mounting plate of said unitary support structure.

22. The unitary support structure of claim 21 and including means for securing a cooling jacket to said forward and rearward mounting plates of the unitary support structure.

23. In a reciprocating-type pump adapted for the pumping of cryogenic liquids and including at least one: (1) pump body having a forward end, a rearward end and a cylindrical bore forming a pumping chamber therein; (2) power frame having a crank shaft comprising the driving means for said pump; (3) reciprocating plunger means connected to the crank shaft of said power frame and extending into the pumping chamber of said pump body through the rearward end thereof and adapted for reciprocating motion therein; (4) valve means in fluid communication with the pumping chamber and adapted for controllably introducing cyrogenic liquid into the pumping chamber during each suction stroke of said plunger and for controllably discharging cryogenic liquid from the pumping chamber during each discharge stroke thereof; and (5) sealing means surrounding said plunger means for sealing the pump against fluid leakage, the improvement comprising a unitary, rigid pump body support structure connected to said power frame, said unitary support structure having a forward end pump body mounting plate, a rearward pump body mounting plate spaced apart from said forward plate, and a power frame mounting plate, said plates being secured together by means of rigid connecting members, said plates having very closely aligned bores therein for each pump body secured thereto and for said sealing means, said pump including packing means supported on the power frame mounting plate of said unitary, rigid pump body support structure, said packing means being separated from the rearward end of the pump body by a distance at least equal to the stroke length of the reciprocating plunger, and including means for leak-tightly coupling the rearward end of the pump body to said packing means comprising (1) a blowby seal cap secured to said rearward mounting plate of the unitary support structure; (2) gasket means compressed between said seal cap and said rearward mounting plate; (3) a packing gland positioned about said plunger in said packing means; (4) a packing gland seal cap positioned about said plunger and secured to the power frame mounting plate by said packing means; (5) sealing means positioned between said packing gland seal cap and said packing gland; and (6) bellows assembly means secured at one end to said blowby seal cap and at its other end to said packing gland seal cap, whereby said unitary support structure can be precisely aligned with and securely connected to said power frame, each pump body mounted on said forward and rearward mounting plates advantageously being of relatively light weight and size providing overall cost savings and enhanced performance capability for said pump.

24. In a reciprocating-type pump adapted for the pumping of cryogenic liquids and including at least one: (1) pump body having a forward end, a rearward end and a cylindrical bore forming a pumping chamber therein; (2) power frame having a crank shaft comprising the driving means for said pump; (3) reciprocating plunger means connected to the crank shaft of said power frame and extending into the pumping chamber of said pump body through the rearward end thereof and adapted for reciprocating motion therein; (4) valve means in fluid communication with the pumping chamber and adapted for controllably introducing cryogenic liquid into the pumping chamber during each suction stroke of said plunger and for controllably discharging cryogenic liquid from the pumping chamber during each discharge stroke thereof; and (5) sealing means surrounding said plunger means for sealing the pump against fluid leakage, the improvement comprising a unitary, rigid pump body support structure connected to said power frame, said unitary support structure having a forward end pump body mounting plate, a rearward pump body mounting plate spaced apart from said forward plate, and a power frame mounting plate, said plates being secured together by means of rigid connecting members, said plates having very closely aligned bores therein for each pump body secured thereto and for said sealing means, said rigid connecting members comprising rigid side plates attached to said forward and rearward pump body mounting plates and to said power frame mounting plate, and including mechanical means for reinforcing said attachment of side plates to the power frame mounting plate, whereby said unitary support structure can be precisely aligned with and securely connected to said power frame, each pump body mounted on said forward and rearward mounting plates advantageously being of relatively light weight and size providing overall cost savings and enhanced performance capability for said pump.

25. In a reciprocating-type pump adapted for the pumping of cryogenic liquids and including at least one: (1) pump body having a forward end, a rearward end and a cylindrical bore forming a pumping chamber therein; (2) power frame having a crank shaft comprising the driving means for said pump; (3) reciprocating plunger means connected to the crank shaft of said power frame and extending into the pumping chamber of said pump body through the rearward end thereof and adapted for reciprocating motion therein; (4) valve means in fluid communication with the pumping chamber and adapted for controllably introducing cryogenic liquid into the pumping chamber during each suction stroke of said plunger and for controllably discharging cryogenic liquid from the pumping chamber during each discharge stroke thereof; and (5) sealing means surrounding said plunger means for sealing the pump against fluid leakage, the improvement comprising a unitary, rigid pump body support structure connected to said power frame, said unitary support structure having a forward end pump body mounting plate, a rearward pump body mounting plate spaced apart from said forward plate, and a power frame mounting plate, said plates being secured together by means of rigid connecting members, said plates having very closely aligned bores therein for each pump body secured thereto and for said sealing means, said rigid connecting members comprising rigid side plates attached to said forward and rearward pump body mounting plates and to said power frame mounting plate, and including gussets as mechanical means for reinforcing said attachment of side plates to the power frame mounting plate, whereby said unitary support structure can be precisely aligned with and securely connected to said power frame, each pump body mounted on said forward and rearward mounting plates advantageously being of relatively light weight and size providing overall cost savings and enhanced performance cpability for said pump.

26. In a reciprocating-type pump adapted for the pumping of cryogenic liquids and including at least one: (1) pump body having a forward end, a rearward end and a cylindrical bore forming a pumping chamber therein; (2) power frame having a crank shaft comprising the driving means for said pump; (3) reciprocating plunger means connected to the crank shaft of said power frame and extending into the pumping chamber of said pump body through the rearward end thereof and adapted for reciprocating motion therein; (4) valve means in fluid communication with the pumping chamber and adapted for controllably introducing cryogenic liquid into the pumping chamber during each suction stroke of said plunger and for controllably discharging cryogenic liquid from the pumping chamber during each discharge stroke thereof; and (5) sealing means surrounding said plunger means for sealing the pump against fluid leakage, the improvement comprising a unitary, rigid pump body support structure connected to said power frame, said unitary support structure having a forward end pump body mounting plate, a rearward pump body mounting plate spaced apart from said forward plate, and a power frame mounting plate, said plates being secured together by means of rigid connecting members comprising rigid side plates attached to said forward and rearward pump body mounting plates and to said power frame mounting plate and a rigid bottom plate attached thereto, said plates having very closely aligned bores therein for each pump body secured thereto and for said sealing means, whereby said unitary support structure can be precisely aligned with and securely connected to said power frame, each pump body mounted on said forward and rearward mounting plates advantageously being of relatively light weight and size providing overall cost savings and enhanced performance capability for said pump.

27. The cryogenic pump of claim 26 in which said connecting members for the mounting plates includes a rigid top plate.

* * * * *